US008955944B2

(12) United States Patent
Watanabe et al.

(10) Patent No.: US 8,955,944 B2
(45) Date of Patent: Feb. 17, 2015

(54) LIQUID EJECTING APPARATUS AND CONTROL METHOD OF LIQUID EJECTING APPARATUS

(71) Applicant: Seiko Epson Corporation, Shinjuku-ku (JP)

(72) Inventors: Yoshihiro Watanabe, Shiojiri (JP); Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/322,788

(22) Filed: Jul. 2, 2014

(65) Prior Publication Data

US 2015/0009261 A1 Jan. 8, 2015

(30) Foreign Application Priority Data

Jul. 3, 2013 (JP) ..... 2013-139472

(51) Int. Cl.
*B41J 2/165* (2006.01)

(52) U.S. Cl.
CPC ..... *B41J 2/16505* (2013.01)
USPC ..... 347/29; 347/17; 347/30

(58) Field of Classification Search
CPC ..... B41J 2/16505
USPC ..... 347/17, 29–35
See application file for complete search history.

(56) References Cited

U.S. PATENT DOCUMENTS 5,508,722 A * 4/1996 Saito et al. ..... 347/17

FOREIGN PATENT DOCUMENTS

JP 2003-276214 A 7/2013

* cited by examiner

*Primary Examiner* — Juanita D Jackson
(74) *Attorney, Agent, or Firm* — Kilpatrick Townsend & Stockton LLP

(57) ABSTRACT

A liquid ejecting apparatus includes a liquid ejecting head, a driving signal generator which generates a micro vibration pulse, a controller which controls applying of the micro vibration pulse to a pressure generation unit, a cap which includes a sealing space not including an absorber inside, and seals a nozzle in the sealing space by being in close contact with the liquid ejecting head, and a suction unit which sucks liquid from a nozzle, in which micro vibration driving which causes liquid in the pressure chamber corresponding to a nozzle to be subjected to a micro vibration by applying at least one or more micro vibration pulses to the pressure generation unit corresponding to the nozzle in which a cleaning operation including a suction operation using the suction unit is performed is intermittently performed.

2 Claims, 7 Drawing Sheets

FIG. 8

| TEMPERATURE (°C) | MICRO VIBRATION APPLICATION TIME (s) | INTERMITTENT TIME (s) | INK | NUMBER OF DOT OMISSIONS IN TEST PRINTING | |
|---|---|---|---|---|---|
| | | | | COMPARISON EXAMPLE | EXAMPLE |
| 15 | 1 | 180 | Bk | 3 | 0 |
| | | | Ye | 3 | 0 |
| | | | Ma | 5 | 0 |
| | | | Cy | 4 | 0 |
| 25 | 1 | 60 | Bk | 2 | 0 |
| | | | Ye | 3 | 0 |
| | | | Ma | 3 | 2 |
| | | | Cy | 5 | 1 |
| 25 | 1 | 180 | Bk | 2 | 0 |
| | | | Ye | 3 | 0 |
| | | | Ma | 3 | 0 |
| | | | Cy | 5 | 0 |
| 25 | 2 | 180 | Bk | 2 | 0 |
| | | | Ye | 3 | 1 |
| | | | Ma | 3 | 0 |
| | | | Cy | 5 | 2 |
| 40 | 1 | 180 | Wt | 2 | 0 |
| | | | Ye | 2 | 0 |
| | | | Ma | 40 | 5 |
| | | | Cy | 13 | 2 |

LIQUID EJECTING APPARATUS AND CONTROL METHOD OF LIQUID EJECTING APPARATUS

This application claims priority to Japanese Patent Application No. 2013-139472, filed Jul. 3, 2013, the entirety of which is incorporated by reference herein.

BACKGROUND

1. Technical Field

The present invention relates to a liquid ejecting apparatus such as an ink jet recording apparatus, and a control method thereof, and in particular, to a liquid ejecting apparatus in which cleaning of a nozzle is performed by causing liquid to be forcibly ejected from the nozzle of a liquid ejecting head, and a control method thereof.

2. Related Art

Liquid ejecting apparatuses include a liquid ejecting head which can eject liquid as droplets from a nozzle, and eject various liquids from the liquid ejecting head. As a representative liquid ejecting head, for example, there is an image recording apparatus such as an ink jet recording apparatus which includes an ink jet recording head (hereinafter, referred to as recording head), and performs recording by ejecting ink of a liquid form from a nozzle of the recording head as ink droplets (hereinafter, referred to as printer), or the like.

In the above described printer, a cleaning operation is performed on a regular basis, in order to recover or maintain an ejecting property of ink which is ejected from a nozzle of a recording head. For example, a suction operation of forcibly discharging ink from a nozzle by reducing a pressure in a sealing space using a pump is performed in a state in which the nozzle is sealed in the sealing space of a cap, by causing the cap to come into contact with a nozzle face on which the nozzle of the recording head is formed (for example refer to JP-A-2003-276214). Due to the suction operation, it is possible to discharge thickened ink, bubbles, or the like, along with ink to a discharging path on which a pump is provided. In addition, in a sealing space of a general cap in the related art, an absorber such as sponge which absorbs ink is provided. The absorber absorbs part of ink which is discharged in a suction operation. For this reason, splattering or bubbling of ink which is discharged into the cap in the suction operation is suppressed by the absorber.

Meanwhile, the above described recording head is also applied to a printer for textile printing which performs recording of an image with respect to cloth such as a textile, a knitted material, a non-woven fabric, or the like, by making use of characteristics which can cause a liquid of a minimum quantity to land on a predetermined position accurately. In addition, as the ink for textile printing, for example, ink which contains a resin is used. By a resin being contained in ink, it is possible to cause a coloring material such as pigment to be fixed on cloth.

The above described ink which includes a resin is easy to solidify, since contained moisture, solvent, or the like, evaporates. For this reason, ink which is absorbed into an absorber of a cap is solidified and accumulated due to a suction operation. As a result, there also is a concern that a discharging path may become clogged, and the suction operation may not be normally performed, not only that an absorption function of ink using the absorber may be lost. In addition, there also is a concern that a nozzle face may be damaged by ink which is solidified and accumulated when the cap comes into contact with the nozzle face.

A configuration in which the absorber is not provided in the sealing space of the cap has been proposed. However, in such a configuration, inconveniences, for example, bubbles being mixed into ink in the nozzle in the suction operation, or a meniscus of the nozzle being broken down become more prevalent. The reason why is that, in the suction operation, in a configuration in which the absorber is not provided in the sealing space, a flow velocity of sucked ink becomes fast compared to the configuration in which the absorber is provided. That is, when the flow velocity of the ink which is sucked from the nozzle becomes fast, a behavior (vibration, or the like) of the meniscus of the nozzle becomes intense, and air is easily mixed into ink in the nozzle. In addition, there also may be a case in which air is mixed into ink due to bubbles of ink which easily occur in the cap, and adhering of the bubbles to the meniscus of the nozzle, or the like, when the inside of the cap is open to the atmosphere due to opening of an atmosphere opening valve after the suction operation, or the like. As a result thereof, there has been a concern that dot omission in which ink is not ejected from the nozzle may occur.

SUMMARY

An advantage of some aspects of the invention is to provide a liquid ejecting apparatus which performs a cleaning operation including a suction operation which sucks a liquid from a nozzle, capable of stably ejecting a liquid even after the cleaning operation, and a control method of the liquid ejecting apparatus.

According to an aspect of the invention, there is provided a liquid ejecting apparatus which includes a liquid ejecting head which causes a pressure change in a pressure chamber by driving a pressure generation unit, and causes liquid containing a resin to be ejected from a nozzle; a driving signal generator which generates a micro vibration pulse which causes a pressure change in liquid in the pressure chamber to an extent in which the liquid is not ejected from the nozzle by applying the micro vibration pulse to the pressure generation unit; a controller which controls applying of the micro vibration pulse to the pressure generation unit; a cap which includes a sealing space not including an absorber inside, and seals a nozzle in the sealing space by being in close contact with the liquid ejecting head; and a suction unit which sucks liquid from a nozzle by reducing a pressure in the sealed sealing space, in which, at a time of a non-recording operation, micro vibration driving which causes liquid in the pressure chamber corresponding to a nozzle to be subjected to a micro vibration by applying at least one or more micro vibration pulses to the pressure generation unit corresponding to the nozzle in which a cleaning operation including a suction operation using the suction unit is performed is intermittently performed.

According to another aspect of the invention, there is provided a control method of a liquid ejecting apparatus which includes a liquid ejecting head which causes a pressure change in a pressure chamber by driving a pressure generation unit, and causes liquid containing a resin to be ejected from a nozzle; a driving signal generator which generates a micro vibration pulse which causes a pressure change in liquid in the pressure chamber to an extent in which the liquid is not ejected from the nozzle by applying the micro vibration pulse to the pressure generation unit; a controller which controls applying of the micro vibration pulse to the pressure generation unit; a cap which includes a sealing space not including an absorber inside, and seals a nozzle in the sealing space by being in close contact with the liquid ejecting head; and a suction unit which sucks liquid from a nozzle by reducing a pressure in the sealed sealing space, the method including intermittently performing micro vibration driving which causes liquid in the pressure chamber corresponding to a nozzle to be subjected to a micro vibration by applying at least one or more micro vibration pulses to the pressure generation unit corresponding to the nozzle in which a cleaning operation including a suction operation using the suction unit is performed, at a time of a non-recording operation.

According to the aspects of the invention, since it is possible to discharge bubbles by intermittently performing micro vibration driving even in a case in which the bubbles are mixed into a liquid in a nozzle in which a cleaning operation is performed, a breakdown of a meniscus of the nozzle can be suppressed. In this manner, it is possible to stably eject a liquid. In addition, it is possible to suppress a progress of thickening of a liquid in the nozzle.

BRIEF DESCRIPTION OF THE DRAWINGS

The invention will be described with reference to the accompanying drawings, wherein like numbers reference like elements.

FIG. 8 is a diagram which describes an effect when the micro vibration driving is intermittently performed.

DESCRIPTION OF EXEMPLARY EMBODIMENTS

Hereinafter, embodiments of the invention will be described with reference to accompanying drawings. In addition, embodiments which will be described below are variously limited as preferable specific examples of the invention, however, the scope of the invention is not limited to the aspects, when there is no description of limiting the invention particularly, in the following descriptions. In addition, in the following descriptions, as a liquid ejecting apparatus of the invention, an ink jet printer (hereinafter, referred to as printer) which performs recording of an image with respect to the front surface of cloth (a type of landing target) such as a textile, a knitted material, a non-woven fabric, or the like, will be exemplified.

Figure 1:
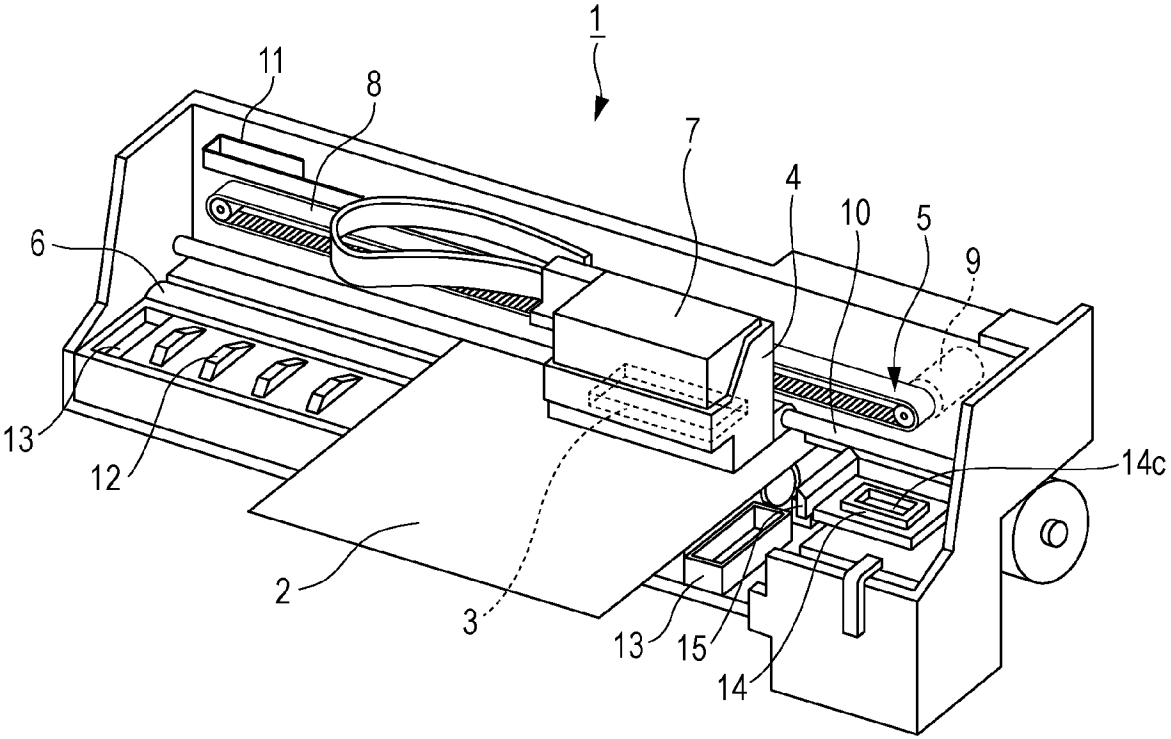
FIG. 1 is a perspective view which describes a configuration of a printer.

FIG. 1 is a perspective view which describes a configuration of a printer 1. The printer 1 includes a recording head 3 which ejects ink, a carriage 4 to which the recording head 3 is attached, a carriage movement mechanism 5 which moves the carriage 4 in the main scanning direction, a transport mechanism 6 which transports cloth 2 in the sub-scanning direction, and the like. As ink in the embodiment, ink containing a resin (resin particles) is used. In addition, the ink will be described in detail later. The ink is reserved in an ink cartridge 7 as a liquid supply source. The ink cartridge 7 is detachably mounted with respect to the recording head 3. In addition, it is also possible to adopt a configuration in which the ink cartridge 7 is arranged on a main body side of the printer 1, and ink is supplied to the recording head 3 through an ink supply tube from the ink cartridge 7.

The above described carriage movement mechanism 5 includes a timing belt 8. In addition, the timing belt 8 is driven by a pulse motor 9 such as a DC motor. Accordingly, when the pulse motor 9 is driven, the carriage 4 is guided to a guide rod 10 which is installed in the printer 1, and performs reciprocating in the main scanning direction (width direction of cloth 2). A position of the carriage 4 in the main scanning direction is detected by a linear encoder 11 which is a type of a position information detection unit. The linear encoder 11 transmits a detection signal thereof, that is, an encoder pulse (a type of position information) to a control unit 41 of the printer 1.

A platen 12 is arranged under the recording head 3 at a time of a recording operation. The platen 12 is arranged at an interval from a nozzle face 25 (nozzle plate 19: refer to FIG. 2) of the recording head 3 when performing a recording operation, and supports the cloth 2. In addition, a flushing box 13 is provided outside of a recording region (printing region) in a movement range of the carriage 4. The flushing box 13 is a member which collects ink which is ejected from the recording head 3 in a flushing operation which is one of the cleaning operations. The flushing box 13 according to the embodiment is formed in a box shape which is opened upward (recording head 3 side). In addition, according to the embodiment, the flushing boxes 13 are provided on both sides of the platen 12 in the main scanning direction. In addition, it is also possible to adopt a configuration in which the flushing box 13 is provided only at one end portion out of both sides in the main scanning direction.

In addition, a home position which is the starting point of main scanning of the carriage 4 is set in an end portion region which is outside of the recording region (printing region) in the movement range of the carriage 4, and outside of the flushing box 13 on one side (right side in FIG. 1). A cap 14 for sealing the nozzle face 25 of the recording head 3, a wiper 15 for wiping the nozzle face 25, and the like, are arranged in the home position. In addition, the printer 1 performs a so-called bidirectional recording in which characters or an image is recorded on the cloth 2 in both directions at a time of a forward movement in which the carriage 4 moves toward an end portion on the opposite side from the home position, and at a time of a backward movement in which the carriage 4 returns to the home position side from the end portion on the opposite side.

Figure 3:
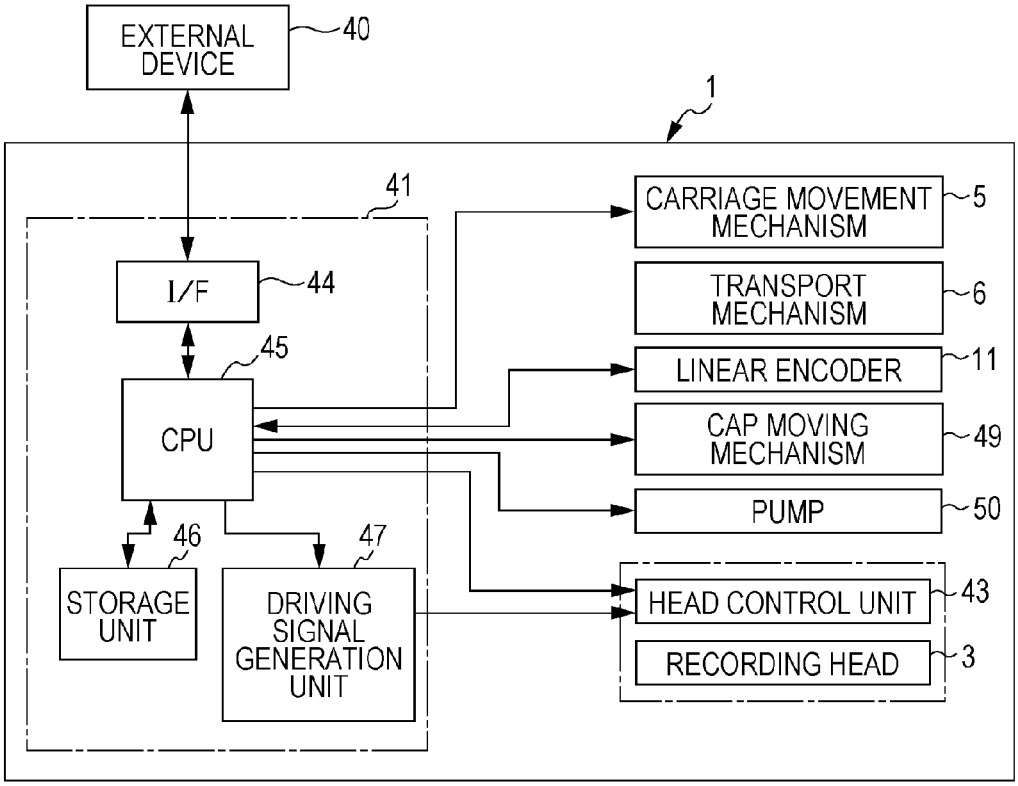
FIG. 3 is a block diagram which describes an electrical configuration of the printer.
Figure 4A:
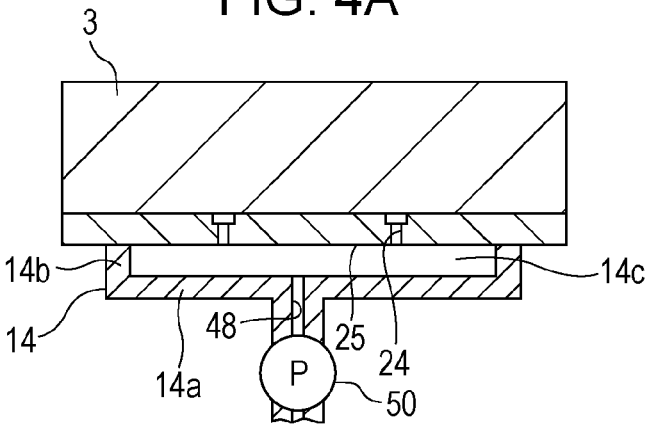
FIGS. 4A to 4C are schematic diagrams which describe cleaning operations.

As illustrated in FIG. 1 or FIG. 4A, the cap 14 is a member in a tray shape which includes a sealing space 14*c* therein, of which a top face (face on side facing nozzle face 25) is open. Specifically, the cap 14 is configured of a rectangular base portion 14*a*, and a side wall portion 14*b* which stands up from the peripheral end of the base portion 14*a*, and the sealing space 14*c* is partitioned by the base portion 14*a* and the side wall portion 14*b*. In addition, the cap 14 causes an upper end of the side wall portion 14*b* to come into close contact with the nozzle face 25 of the recording head 3 which stands by at the home position by moving up and down due to a cap movement mechanism 49 (refer to FIG. 3), and seals (encapsulates) a nozzle 24 in the sealing space 14*c*. In addition, the cap 14 according to the embodiment is formed using an elastic member such as rubber. In this manner, it is possible to improve adherence of the nozzle face 25 and the cap 14, and to reliably seal the nozzle 24. In addition, the sealing space 14*c* is partitioned only by a structural surface of the cap 14 which is configured of the base portion 14*a* and the side wall portion 14*b*, and an absorber (for example, sponge, or the like) which is formed of a porous member which absorbs ink is not arranged therein. For this reason, it is possible to prevent ink from remaining in the sealing space 14*c* without being collected in the absorber, when a suction operation in which ink is sucked from the nozzle 24 using a pump 50 which will be described later is performed. As a result, it is possible to prevent the nozzle face 25 from being damaged by ink which is solidified in the sealing space 14*c* when the cap 14 comes into contact with the nozzle face 25.

In addition, as illustrated in FIG. 4A, an upper end of an ink discharging path 48 is open to the base portion 14*a* of the cap 14. The pump 50 (corresponding to suction unit in the invention) which reduces a pressure in the sealing space 14*c* which is sealed is connected to the middle of the ink discharging path 48. For this reason, when the pump 50 is operated in a state in which the nozzle face 25 is sealed using the cap 14 (state in which nozzle 24 is sealed in sealing space 14*c*), a pressure in the sealing space 14*c* is reduced, and it is possible to suck bubbles or thickened ink from the nozzle 24. In addition, the sucked ink, or the like, is discharged to a tank, or the like, which is not shown through the ink discharging path 48. In addition, though it is not illustrated, the sealing space 14*c* of the cap 14 communicates with the atmosphere through an atmosphere opening path. In addition, the atmosphere opening path is configured so as to be open and closed using an atmosphere opening valve which is also not shown.

Figure 4B:
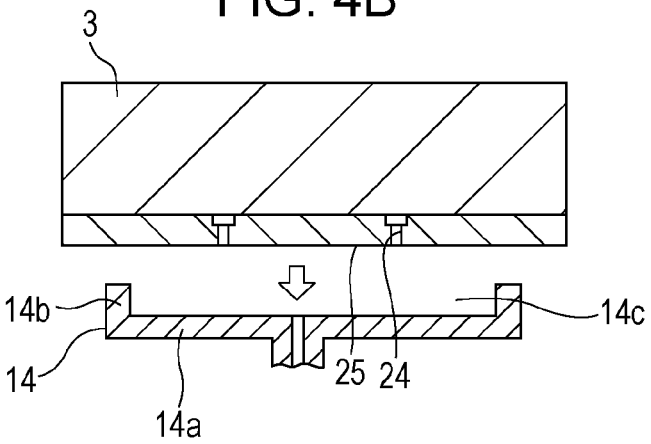
Figure 4C:
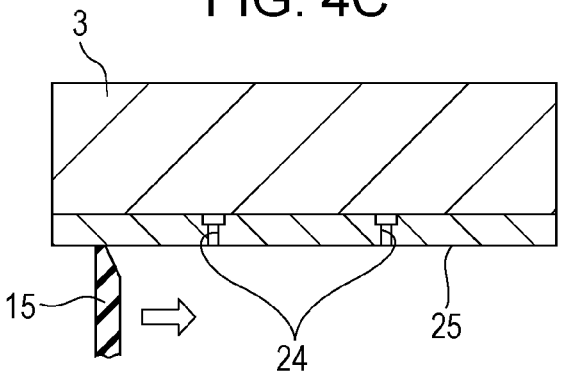

As illustrated in FIG. 1 or FIG. 4C, the wiper 15 is a plate shaped member which stands up upward (recording head 3 side), and is formed of an elastic member such as rubber. The width of the wiper 15 (dimension in direction orthogonal to wiping direction (sub-scanning direction)) is set to a size which can wipe the nozzle face 25. In addition, the wiper 15 is set so as to proceed or retreat to a wiping position at which a tip end portion comes into contact with the nozzle face by overlapping with the movement path of the recording head 3, and a retreat position at which the tip end portion of the wiper 15 does not come into contact with the nozzle face 25 of the recording head 3 by deviating from the movement path. When the nozzle face 25 of the recording head 3 is wiped, the wiper 15 is moved to the wiping position, and the recording head 3 and the wiper 15 are relatively moved in a state in which the tip end portion of the wiper 15 comes into contact with the nozzle face 25. In this manner, the wiper 15 wipes ink, or the like, which adheres to the nozzle face 25. According to the embodiment, it is configured such that the wiper 15 wipes the nozzle face 25 by the recording head 3 being moved in the main scanning direction. In addition, a contact portion at which the nozzle face 25 and the wiper 15 come into contact is moistened with a liquid which is formed of a solvent of ink, water, or the like, so that the nozzle face 25 is smoothly wiped. In addition, it is also possible to use a cloth wiper of which a contact portion with the nozzle face 25 is formed of cloth. In addition, it is also possible to adopt a configuration in which the nozzle face is wiped when the wiper 15 runs by itself in a state in which a position of the recording head 3 is fixed.

The ink according to the embodiment is ink for textile printing, and for example, ink containing a resin is used. Hereinafter, ingredients included in the ink will be described in detail.

For a pigment contained in ink, it is possible to use any one of an organic pigment and an inorganic pigment. For the pigment contained in ink, it is also possible to use any one of white-based pigments and pigments other than a white-based pigment.

As the white-based pigment, though it is not limited to the following, there are white inorganic pigments such as titanium oxide, zinc oxide, zinc sulfide, antimonious oxide, and zirconium oxide, for example. It is also possible to use white organic pigments such as white hollow resin particles and high polymer particles, in addition to the white inorganic pigments.

A pigment other than a white-based pigment is a pigment other than the above described white-based pigments. For example, it is possible to use organic pigments which are azo-based, phthalocyanine-based, dye-based, condensed polycycle-based, nitro-based, and nitroso-based (brilliant carmine 6B, lake red C, Watchung red, disazo yellow, Hansa Yellow, phthalocyanine blue, phthalocyanine green, alkaline blue, aniline black, or the like), from a metal group such as cobalt, iron, chromium, copper, zinc, lead, titanium, vanadium, manganese, and nickel, metal oxide and sulfide, from a carbon black group such as furnace carbon black, lampblack, acetylene black, and channel black (C.I. pigment black 7), and inorganic pigments such as yellow ocher, sea blue, and Berlin blue.

Though a content of the pigment which is contained in ink is different depending on a type of pigment to be used, in order to secure a good color developing property, equal to or greater than 1 mass % and equal to or smaller than 30 mass % is preferable, equal to or greater than 5 mass % and equal to or smaller than 15 mass % is more preferable, and equal to or greater than 5 mass % and equal to or smaller than 12 mass % is still more preferable, with respect to a total mass of the ink. Among these, when titanium oxide is used as the pigment contained in the ink, a content of the titanium oxide of equal to or greater than 3 mass % and equal to or smaller than 25 mass % is preferable, and a content of equal to or greater than 5 mass % and equal to or smaller than 20 mass % is more preferable with respect to the total mass of the ink since titanium oxide is precipitated with difficulty (in particular, on cloth 2 with low brightness), and is superior in concealment characteristics and color reproduction characteristics.

The pigment may be a pigment which is subjected to a surface treatment in order to increase dispersibility in the ink, and may be a pigment in which a dispersing agent, or the like, is used.

The pigment which is subjected to the surface treatment is a pigment in which a hydrophilic group (carboxyl group, sulfonic acid group, or the like) is coupled directly or indirectly on the surface of the pigment using physical processing or chemical processing, and is caused to be dispersed in an aqueous solvent (hereinafter, also referred to as "self-dispersion type pigment").

In addition, the pigment in which the dispersion agent is used is a pigment which is dispersed using a surfactant or a resin (hereinafter, also referred to as "polymer dispersion-type pigment"), and it is possible to use a well-known substance for the surfactant and the resin. In addition, in the "polymer dispersion-type pigment", a pigment which is coated using a resin is also included. The pigment which is coated with the resin can be obtained using an acid deposition method, a phase inversion emulsification method, a mini-emulsion polymerization method, or the like.

The ink contains a resin. Since it is possible to improve adherence of the ink and the cloth 2 by the resin being contained, it is possible to improve friction resistance of an image which is formed using the ink.

Since the ink set for textile printing according to the embodiment is usually used in recording with respect to a recording medium which has good elasticity such as the cloth 2, it is preferable that an image to be recorded (that is, ink film formed using ink) be an image having good elasticity (easy to extend). That is, when the ink film has elongation which can be expanded and contracted conforming with elasticity of the cloth 2, it is possible to prevent cracking and breaking of the ink film, and to secure washing fastness and friction fastness. From these standpoints, film elongation of the resin which is contained in the ink is preferable when being equal to or greater than 400% and equal to or smaller than 1200%, more preferable when being equal to or greater than 500% and equal to or smaller than 1200%, is still more preferable when being equal to or greater than 600% and equal to or smaller than 1200%, and is particularly preferable when being equal to or greater than 700% and equal to or smaller than 1200%. When the film elongation is in the above described range, and is not less than the lower limit among other things, it is possible to form an image which has a good conforming property with respect to the elasticity of the cloth 2. In addition, since it is possible to maintain viscosity of the ink film in an appropriate range, and to suppress deterioration in an anchor effect with respect to the cloth 2, when the film elongation is in the above described range, and does not exceed the upper limit among other things, it is possible to form an image which is also good in washing fastness and friction fastness (friction resistance) while suppressing deterioration in fixity.

In addition, since the resin which is contained in the ink can prevent the cracking and breaking of the ink film, and can secure the washing fastness and friction fastness, a glass transition point (Tg) of the resin is preferable when being equal to or smaller than 0 C, and is more preferable when being equal to or smaller than −10 C. In addition, it is preferable that the lower limit of the glass transition point (Tg) be equal to or greater than −80 C. In addition, a minimum film forming temperature (MFT) is preferable when being equal to or smaller than 0 C, and is more preferable when being equal to or smaller than −10 C, since the resin which is contained in the ink can prevent the breaking and cracking of the ink film, and can secure the washing fastness and friction fastness. In addition, it is preferable that the lower limit of the minimum film forming temperature be equal to or greater than −80 C.

It is preferable that the resin contained in the ink be an emulsion so as to improve friction resistance and adherence of the film, and a preservation stability of the ink. The resin contained in the ink may be self-emulsifying resin in which a necessary hydrophilic ingredient is introduced in order to be stably dispersed in water, or may be water dispersible resin through using an external emulsifier, however, in order to prevent a reaction between a pretreatment liquid and the ink from being inhibited, it is preferable that the resin be a self-emulsifying dispersing element (self-emulsifying emulsion) which does not include an emulsifier.

As the resin, for example, it is possible to use an acrylic resin, a styrene acrylic resin, a fluorine-based resin, a urethane-based resin, a polyolefin-based resin, a rosin denaturation resin, a terpene-based resin, a polyester-based resin, a polyamide-based resin, an epoxy-based resin, a vinyl chloride-based resin, vinyl chloride-vinyl acetate copolymer, an ethylene vinyl acetate-based resin, or the like. These resins may be used as a single resin of one type, or two or more types may be used together. Among these, it is preferable to use at least one type which is selected from the urethane-based resin and the acrylic resin, and it is more preferable to use the urethane-based resin since a degree of freedom in design is high, and furthermore, it is easy to obtain desired film physical properties (above described film elongation).

The content of the resin in the ink is preferable when being equal to or greater than 1 mass % and equal to or smaller than 15 mass %, is more preferable when being equal to or greater than 5 mass % and equal to or smaller than 15 mass %, and is still more preferable when being equal to or greater than 8 mass % and equal to or smaller than 15 mass % for all mass of the ink, in a solid content conversion. Since it is possible to obtain a sufficient effect of improving fixity of ink by the resin when the content of the resin in the ink is in the above described range, and is not less than the lower limit, friction resistance of the recorded image is improved. In addition, since it is possible to suppress occurrence of aggregates due to the resin when the content of the resin does not exceed the upper limit, an excellent preservation stability or ejection stability of the ink can be obtained.

In addition to this, the ink may contain water, an organic solvent, a surfactant, a pH modifier, a preservative, an anti-fungal agent, or the like.

Figure 2:
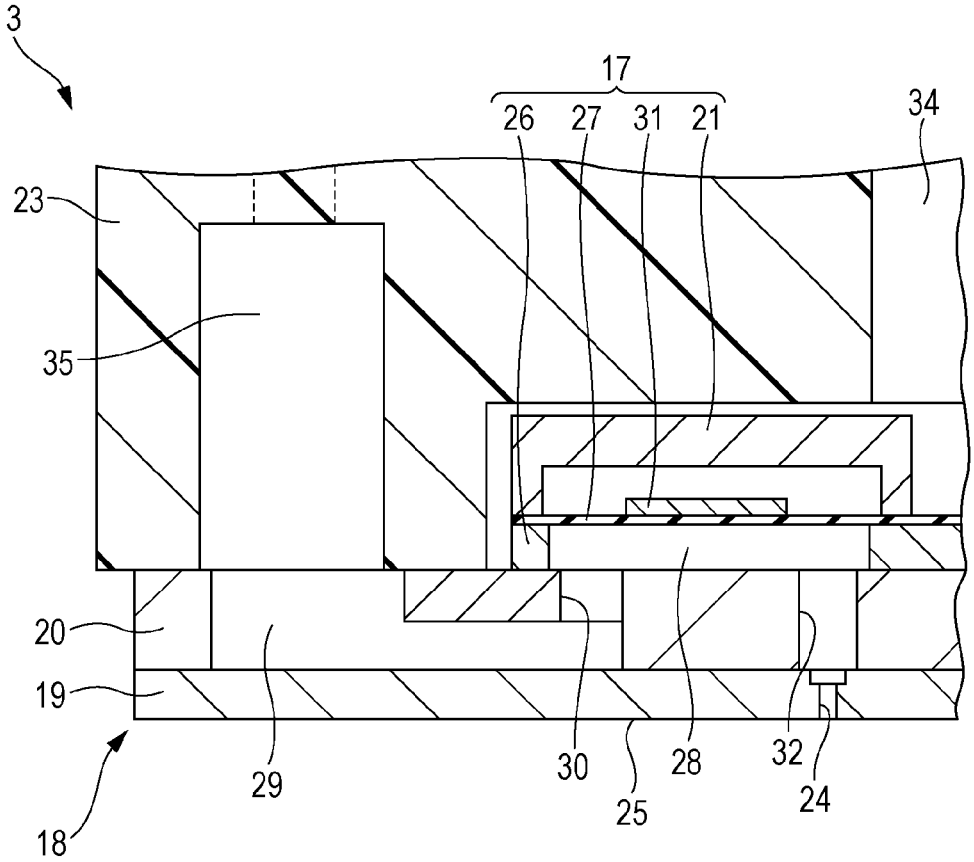
FIG. 2 is a cross-sectional view which describes a configuration of a recording head.

Subsequently, the recording head 3 will be described. FIG. 2 is a schematic cross-sectional view of the recording head 3. In addition, in FIG. 2, a configuration of main portions corresponding to nozzle columns on the other side is omitted since the main portions are symmetric to those which are illustrated in the horizontal direction. As illustrated in FIG. 2, the recording head 3 according to the embodiment has a configuration in which the recording head includes a pressure generation unit 17 and a flow path unit 18, and these members are attached to a case 23 in a state of being laminated.

The case 23 is a box shaped member which is formed of synthetic resins, or the like. As illustrated in FIG. 2, a rectangular penetrating hollow unit 34 is formed at a center portion of the case 23 in a state of penetrating the case 23 in the height direction along the nozzle column direction. In addition, one end of a flexible cable (not shown) is accommodated in the penetrating hollow unit 34. In addition, an ink introduction path 35 is formed in the case 23. An upper end of the ink introduction path 35 is connected to a flow path on the upstream side, and a lower end thereof is connected to a common liquid chamber 29 (reservoir) of the flow path unit 18. In this manner, ink from the ink cartridge 7 is introduced to the common liquid chamber 29 through the ink introduction path 35.

The flow path unit 18 includes a nozzle plate 19 (a type of nozzle formation member) in which a plurality of nozzles 24 are linearly (column shape) provided, and a communicating substrate 20 on which the common liquid chamber 29 is provided. The plurality of nozzles 24 which are provided in a column are provided at even intervals at a pitch corresponding to a dot formation density from a nozzle 24 on one end side to a nozzle 24 on the other end side. According to the embodiment, a nozzle column (a type of nozzle group) is configured by being provided with 360 nozzles 24 in a column at a pitch corresponding to 360 dpi. In addition, according to the embodiment, two nozzle columns are formed in the nozzle plate 19. The common liquid chamber 29 is a hollow portion which is formed in a series along the nozzle column direction, and is formed in two columns corresponding to two nozzle columns. A plurality of liquid introduction ports 30 which communicate with the pressure chambers 28 are provided corresponding to each pressure chamber 28 on the nozzle 24 side (pressure chamber 28 side) of the common liquid chamber 29. In addition, a lower face of the nozzle plate 19 corresponds to the nozzle face 25.

The pressure generation unit 17 is made into a unit by being laminated with a pressure chamber forming substrate 26 (a type of pressure chamber forming member) on which the pressure chamber 28 is formed, an elastic film 27, a piezoelectric element 31, and a protecting substrate 21. In addition, ink is introduced to the pressure chamber 28 through the liquid introduction port 30 from the common liquid chamber 29, and a pressure change is caused in the pressure chamber 28 by driving the piezoelectric element 31, by supplying a driving signal from the control unit 41 to the piezoelectric element 31 through the flexible cable. Ink droplets are ejected from the nozzle 24 through a nozzle communication path 32 which penetrates the communicating substrate 20, using the pressure change.

Subsequently, an electrical configuration of the printer 1 will be described. FIG. 3 is a block diagram which describes the electrical configuration of the printer 1. The printer 1 includes a carriage movement mechanism 5, the transport mechanism 6, the linear encoder 11, a cap movement mechanism 49, the pump 50, the recording head 3, and the control unit 41. In addition, an external device 40 is an electronic device which handles an image of a computer, a digital camera, or the like, for example. The external device 40 is connected to the control unit 41 of the printer 1 so as to communicate, and transmits print data corresponding to an image, or the like, to the printer 1 in order to print the image, or the like, on the cloth 2 in the printer 1.

The control unit 41 is a controller which performs a control of each unit of the printer 1, and includes an interface (I/F) unit 44, a CPU 45, a storage unit 46, and a driving signal generation unit 47 (corresponding to driving signal generator in the invention). The interface unit 44 performs data transceiving with the printer 1, for example, receiving of printing data which is transmitted to the printer 1 from the external device 40 or a printing command, or transmitting state information of the printer 1 to the external device 40. The storage unit 46 is an element which stores data which is used in a program of the CPU 45, or in various controls, and includes a ROM, a RAM, and a NVRAM (non-volatile storage element). The CPU 45 is an arithmetic processing unit which performs the entire control of the printer 1, and controls each unit according to a program which is stored in the storage unit 46. In addition, the CPU 45 functions as a timing pulse generation unit which generates a timing pulse PTS from an encoder pulse which is output from the linear encoder 11. In addition, the CPU 45 controls a transmission of printing data by causing the data to be synchronized with respect to the timing pulse PTS, a generation of a driving signal using the driving signal generation unit 47, or the like. In addition, the CPU 45 controls a cleaning operation in which the nozzles 24 and the nozzle face 25 are cleaned, by controlling the cap movement mechanism 49 and the pump 50. In addition, the cleaning operation will be described in detail later.

Figure 6:
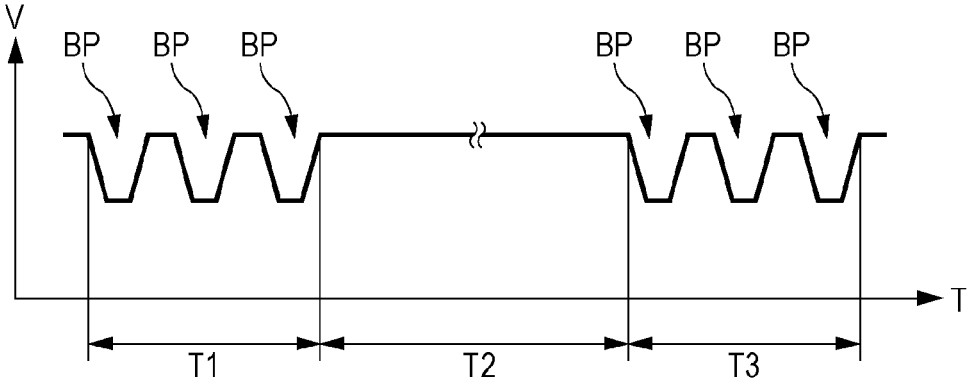
FIG. 6 is a diagram which describes a driving signal which performs micro vibration driving intermittently.

The driving signal generation unit 47 generates analog voltage signals based on waveform data relating to a waveform of a driving signal COM. The voltage signal is subjected to power amplification, and the driving signal COM is generated. Here, the driving signal COM in a recording operation is a series of signals which includes an ejecting pulse which ejects ink from the nozzles 24 of the recording head 3. A plurality of ejecting pulses are included in the driving signal COM in a unit period T which is a repeated cycle of generating the driving signal COM. In addition, the driving signal COM which causes a micro vibration of ink in the pressure chamber 28 is a series of signals which includes at least one or more of a micro vibration pulse BP which causes a pressure change of the ink in the pressure chamber 28 to an extent in which ink is not ejected from the nozzle 24. According to the embodiment, as illustrated in FIG. 6, a plurality of (three in FIG. 6) micro vibration pulses BP are included in the unit period (T1 or T3). In addition, the ejecting pulse and the micro vibration pulse BP are a type of a driving voltage which causes the piezoelectric element 31 to perform a predetermined operation.

Figure 5:
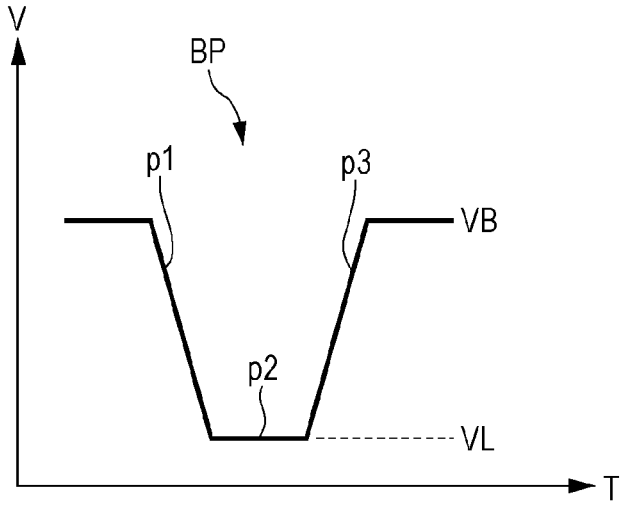
FIG. 5 is a waveform chart which describes an example of a micro vibration pulse.

FIG. 5 is a waveform chart which describes an example of the micro vibration pulse BP. In addition, a vertical axis in FIG. 5 denotes voltage, and a horizontal axis denotes time. The micro vibration pulse BP includes an expansion element p1, an expansion maintaining element p2, and a contraction element p3. The expansion element p1 causes the pressure chamber 28 to expand when a potential is changed to a negative side from a reference potential (intermediate potential) VB to a minimum potential (minimum voltage) VL. The expansion maintaining element p2 maintains the minimum potential VL for a fixed time. The contraction element p3 causes the pressure chamber 28 to contract when the potential is changed to a positive side from the minimum potential VL to the reference potential (intermediate potential) VB. Due to the contraction, ink in the pressure chamber 28 is pressurized to an extent in which the ink in the pressure chamber 28 is not ejected from the nozzle 24. In addition, a relatively slow pressure change occurs in the pressure chamber 28 along with a series of capacity changes in the pressure chamber 28, and due to this pressure change, the ink in the pressure chamber 28, and a liquid surface (meniscus) of the ink which is exposed to the nozzle 24 are stirred by being subjected to a micro vibration. In addition, the micro vibration pulse BP is not limited to a waveform which changes to the negative side from the reference potential VB as exemplified in FIGS. 5 and 6, and may be a waveform which changes to the positive side from the reference potential VB. In addition to this, the waveform may be a waveform in any shape when being a waveform which causes a pressure change in the ink in the pressure chamber 28 to an extent in which the ink is not ejected from the nozzle 24.

A head control unit 43 performs an application control of the driving signal COM with respect to the piezoelectric element 31 of the recording head 3 based on a head control signal from the CPU 45. Specifically, the head control unit 43 selects an ejection pulse from the driving signal COM based on ejection data from the CPU 45, and applies the pulse to the piezoelectric element 31. In addition, the head control unit 43 performs an application control of the driving signal COM so that micro vibration driving is intermittently performed with respect to the pressure chamber 28 which corresponds to the nozzle 24 at which the cleaning operation is performed, based on a head control signal from the CPU 45. For example as illustrated in FIG. 6, after the cleaning operation, the ink in the pressure chamber 28 is subjected to the micro vibration in the pressure chamber 28 by applying the micro vibration pulse BP to the piezoelectric element 31 during an application time T1. Thereafter, the driving signal COM which is applied to the piezoelectric element 31 is maintained at a fixed potential (reference potential VB) during an intermittent time T2, and the piezoelectric element 31 is not vibrated. In addition, after the intermittent time T2, the ink in the pressure chamber 28 is subjected to the micro vibration during an application time T3 by applying the micro vibration pulse BP to the piezoelectric element 31 again. In this manner, it is possible to suppress a so-called dot omission in which ink is not ejected from a nozzle 24 by repeatedly performing an intermittent operation of the micro vibration driving. This matter will be described later. In addition, the control unit 41 and the head control unit 43 correspond to the controller of the invention.

Subsequently, the cleaning operation in which the nozzles 24 and the nozzle face 25 are cleaned will be described. The cleaning operation is an operation which is regularly performed in order to recover or maintain an ejection property of ink which is ejected from the nozzles 24 of the recording head 3 at a time of a non-recording operation. For example, the cleaning operation is performed immediately before the first recording operation after starting of the printer 1, or after the first ink filling after installing (exchanging) an appliance (ink cartridge 7, or the like). In addition, the cleaning operation may be performed every time a predetermined time period elapses, in every pass of a predetermined number of times (scanning of recording head 3), or every time a predetermined number of pages are printed, in an interval of the recording operation. The cleaning operation according to the embodiment includes a suction operation, a wiping operation, and a flushing operation.

When the cleaning operation is started, first, the carriage movement mechanism 5 is driven, and the recording head 3 is moved to the home position. Subsequently, as illustrated in FIG. 4A, the cap movement mechanism 49 is driven, the cap 14 is moved upward (recording head 3 side), and an upper end of the side wall portion 14*b* is caused to come into close contact with the nozzle face 25 of the recording head 3. In addition, the above described atmosphere opening valve is closed. In this manner, the nozzles 24 are sealed (encapsulated) in the sealing space 14*c*. In this state, the pump 50 is driven, and the suction operation is performed. That is, a pressure in the sealing space 14*c* which is sealed is reduced due to driving of the pump 50, and ink is discharged to the ink discharging path 48 side (sucked) from the nozzle 24. Along with the discharging, bubbles or thickened ink is discharged from the nozzle 24. Thereafter, the atmosphere opening valve is opened, the inside of the sealing space 14*c* is restored to the atmospheric pressure, and as illustrated in FIG. 4B, the cap 14 is move downward by driving the cap movement mechanism 49 again.

Subsequently, the wiping operation using the wiper 15 is performed. The wiper 15 is moved to a wiping position, and the recording head 3 is moved to a side opposite to the home position in a state in which the tip end portion of the wiper 15 comes into contact with the nozzle face 25. In this manner, as illustrated in FIG. 4C, the wiper 15 relatively moves from one side to the other side in the main scanning direction of the nozzle face 25, and wipes the nozzle face 25.

Finally, the recording head 3 is moved to the upper part of the flushing box 13, and the flushing operation is performed. The flushing operation is performed by applying a flushing pulse to the piezoelectric element 31, which is set so that a pressure change in the pressure chamber 28 is set to be larger than the ejection pulse at the time of the recording operation. For this reason, an amount of ink which is ejected due to driving of the piezoelectric element 31 of one time in the flushing operation becomes larger than that in the recording operation. In this manner, it is possible to further discharge bubbles or thickened ink from the nozzle 24. In addition, after the flushing operation, the cleaning operation is ended by moving the recording head 3 to the home position. In addition, at this time, it is also possible to seal the nozzle face 25 of the recording head 3 which stands by at the home position using the cap 14 by driving the cap movement mechanism 49. In this manner, it is possible to prevent the ink in the recording head 3 from being thickened.

Figure 7A:
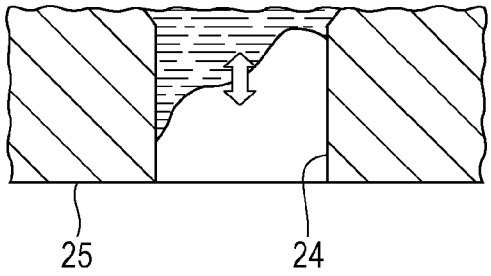
FIGS. 7A to 7C are schematic diagrams which describe states of a meniscus of a nozzle.
Figure 7B:
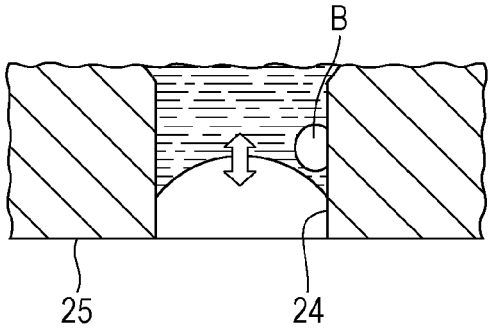

Meanwhile, as illustrated in FIG. 7A or 7B, there is a concern that the meniscus of the nozzle 24 may break down, or bubbles may be mixed into ink in the nozzle 24 when performing the above described cleaning operation. Here, the breakdown of the meniscus is a state in which the ink surface in the nozzle 24 is changed from a normal state of a concave shape (refer to FIG. 7C), and a predetermined ejection property of ink cannot be obtained when ejecting the ink. For example, as illustrated in FIG. 7A, the breakdown of the meniscus is a state in which a part of the ink surface in the nozzle 24 comes deep into the nozzle 24 (pressure chamber 28 side). In particular, since a configuration of not providing an absorber in the sealing space 14*c* of the cap 14 is adopted in the embodiment, mixing of bubbles into the ink in the nozzle 24, or the breakdown of the meniscus more easily occurs. When such mixing of bubbles into the ink, or breakdown of the meniscus occurs, there is a concern that a so-called dot omission in which ink is not ejected from the nozzle 24 may occur. As a cause of such inconveniences, the following reason which will be described is taken into consideration.

In the suction operation, there is a concern that a behavior of the meniscus of the nozzle 24 (vibration, or the like) may become intense, and bubbles may be mixed into the ink in the nozzle 24 when sucking the ink from the nozzle 24. In particular, in a configuration in which the absorber is not provided in the sealing space 14*c*, since a flow velocity of the sucked ink becomes fast compared to the configuration in which the absorber is provided, the behavior of the meniscus (vibration, or the like) becomes more intense, and bubbles are mixed into the ink more easily. Due to this, a risk of breakdown of the meniscus becomes high. In addition, the cap 14 is separated from the nozzle face 25 after restoring of the sealing space 14*c* to the atmospheric pressure, of which a pressure is reduced after the suction operation, however, the meniscus vibrates due to a change in an atmospheric pressure when being open to the atmosphere, or a change in an atmospheric pressure when the cap 14 is separated. There is a concern that bubbles may be mixed into the ink in the nozzle 24, or the meniscus may be broken down due to the vibration. In addition, there is a concern that bubbles may be mixed into the ink in the nozzle 24 at the time of the wiping operation using the wiper 15, as well. This is because, there is a concern that bubbles may be mixed into the ink in the nozzle 24 along with the liquid when performing the wiping operation, since a contact portion of the wiper 15 which comes into contact with the nozzle face 25 gets wet with liquid which is formed of a solvent of the ink, water, or the like.

In order to suppress an ejection failure (dot omission) which occurs due to such a factor, in the invention, micro vibration driving in which ink in the pressure chamber 28 is subjected to a micro vibration by applying a micro vibration pulse is intermittently performed at a time of the non-recording operation after the cleaning operation. In this manner, it is possible to discharge bubbles which are mixed into the ink, and to recover the meniscus which is broken down. As the reason for this, the following hypotheses are taken into consideration.

Figure 7C:
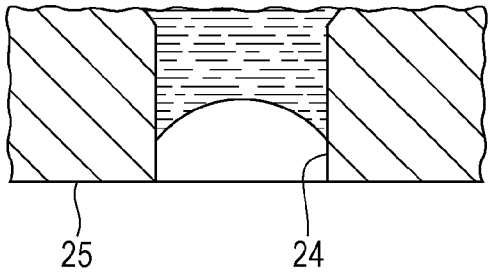

For example as illustrated in FIG. 7A, in a state in which the meniscus is broken down, and a part of the ink surface in the nozzle 24 comes deep into the nozzle 24 (pressure chamber 28 side), the ink in the pressure chamber 28 is subjected to the micro vibration by applying a micro vibration pulse to the piezoelectric element 31 during a predetermined application time (for example, for several seconds). Due to this, the ink surface in the nozzle 24 which communicates with the pressure chamber 28 vibrates. Thereafter, the driving signal COM which is applied to the piezoelectric element 31 is maintained at a fixed potential during a predetermined intermittent time (for example, during several seconds to several thousand seconds), and the piezoelectric element 31 is not vibrated. Due to this, the ink surface which becomes easy to move due to the vibration tries to return to a stable state, that is, a normal meniscus position as illustrated in FIG. 7C due to a surface tension or a capillary action. In particular, an end portion of the liquid surface which comes deep into the nozzle 24 moves downward along a wall face which partitions the nozzle 24 using the capillary action. At this time, there is a case in which the end portion moves to the lower part of the normal meniscus position, however, it is possible to return the end portion to the normal meniscus position by applying the micro vibration pulse to the piezoelectric element 31 again during the predetermined application time, and causing the ink surface in the nozzle 24 to vibrate, after the intermittent time. By repeatedly performing such intermittent micro vibration driving, it is possible to restore the broken down meniscus. In addition, it is confirmed that it is difficult to restore the broken down meniscus, when the intermittent time is not provided during the micro vibration driving, and the micro vibration driving is continuously performed. The reason is that it is difficult for the liquid surface which comes deep into the nozzle 24 to move downward along the wall face, when the ink surface is continuously vibrated.

In addition, for example as illustrated in FIG. 7B, even when a bubble B is mixed into the ink in the nozzle 24, it is possible to remove the bubble B by vibrating the ink surface in the nozzle 24 by applying a micro vibration pulse to the piezoelectric element 31 during a predetermined application time. Specifically, the bubble B which is mixed into the ink in the nozzle 24 is in a state of being in close contact with the wall face which partitions the nozzle 24. When the ink surface is vibrated in this state, the bubble B is separated from the wall face due to the vibration. Alternatively, the bubble B becomes easy to move. In addition, the bubble B is released to the atmosphere by being absorbed in the ink surface due to a surface tension, or the like, by causing the ink surface in the nozzle 24 to be left unattended without vibrating (driving) the piezoelectric element 31 during a predetermined intermittent time, after the micro vibration. In this manner, it is possible to return to a normal state in which bubbles are not mixed into the ink in the nozzle 24.

In this manner, it is possible to prompt discharging of bubbles which are mixed into ink, or restoring of a broken down meniscus using a surface tension, or the like, by causing the ink surface in the nozzle 24 to be left unattended without driving the piezoelectric element 31, after causing a vibration (micro vibration) on the ink surface in the nozzle 24 at the time of the non-recording operation after the cleaning operation. As a result, it is possible to prevent bubbles from being mixed into ink, or to prevent the meniscus of the nozzle 24 from breaking down. In addition, by repeating such vibrating and neglecting of the ink surface, that is, by intermittently performing the micro vibration driving, it is possible to more reliably discharge bubbles which are mixed into ink, or to restore the broken down meniscus.

FIG. 8 is an experimental result when the micro vibration driving is intermittently performed after the cleaning operation. An "example" in FIG. 8 is a case in which the intermittent micro vibration driving according to the invention is performed, and a "comparison example" is a case in which the intermittent micro vibration driving is not performed. After the cleaning operation, a printing test of ejecting ink from the nozzles 24 is performed, and how many nozzles 24 in which dot omission occurs there are is compared in the example and the comparison example. In addition, at each temperature of 15 C, 25 C, and 40 C, experiments for each of BK (black ink), Ye (yellow ink), Ma (magenta ink), and Cy (cyan ink) are performed. In addition, when a temperature is 25 C, a plurality of experiments in which a micro vibration application time and an intermittent time are set to be different are performed. Specifically, experiments of three patterns in total for a case in which the application time is set to 1 second, and the intermittent time is set to 60 seconds, a case in which the application time is set to 1 second, and the intermittent time is set to 180 seconds, and a case in which the application time is set to 2 seconds, and the intermittent time is set to 180 seconds are performed. In addition, in a case in which temperatures are 15 C and 40 C, only the experiment in which the application time is set to 1 second, and the intermittent time is set to 180 seconds is performed. As illustrated in FIG. 8, in the case in which the intermittent micro vibration driving is performed after the cleaning operation, the number of nozzles 24 in which the dot omission occurs decreases in all conditions, compared to the case in which the intermittent micro vibration driving is not performed (comparison example).

In this manner, since the micro vibration driving in which the ink in the pressure chamber 28 is subjected to the micro vibration by applying the micro vibration pulse with respect to the piezoelectric element 31 is intermittently performed after the cleaning operation, it is possible to discharge bubbles even when the bubbles are mixed into the ink in the nozzle 24 in which the cleaning operation is performed, and to prevent the meniscus of the nozzle 24 from breaking down. In this manner, it is possible to stably eject ink. In addition, in a case in which ink containing a resin is used as in the embodiment, when the ink in the pressure chamber 28 is continuously subjected to the micro vibration, thickened ink in the vicinity of the meniscus is stirred, and the thickened ink is sent to the pressure chamber 28 side, however, on the other hand, since ink which is not thickened is sent to the vicinity of the meniscus, thickening is accelerated. However, according to the invention, since the micro vibration driving is intermittently performed, without being continuously performed, it is possible to suppress progressing of thickening of the ink in the nozzle 24.

Meanwhile, according to the embodiment, the suction operation, the wiping operation, and the flushing operation are included in the cleaning operation, however, it is not limited to this. The cleaning operation may include the suction operation and the wiping operation. In addition, according to the embodiment, the micro vibration driving is intermittently performed after the cleaning operation, however, it is not limited to this. For example, in the cleaning operation including the suction operation and the wiping operation, it is also possible to intermittently perform the micro vibration driving in the pressure chamber corresponding to a nozzle on a nozzle face which is already wiped, even in the middle of wiping the nozzle face using the wiper. In short, even in the middle of the cleaning operation, it is possible to make ink in the pressure chamber corresponding to the nozzle to be subject to the micro vibration intermittently, by applying the micro vibration pulse to the piezoelectric element corresponding to the nozzle in which the cleaning operation is performed.

In addition, according to the embodiment, the side wall portion 14*b* of the cap 14 is caused to come into close contact with the nozzle face, and the nozzles 24 are sealed (encapsulated) in the sealing space 14*c*, however, it is not limited to this. For example, in a recording head in which a nozzle plate is miniaturized as much as possible, and another member around the nozzle plate (for example, compliance sheet which functions as compliance unit in common liquid chamber, fixing plate which fixes recording head, or the like) is exposed, on the lower face of the recording head, the side wall portion of the cap may be caused to come into close contact with another member which is located outside the nozzle plate. In this manner, it is possible to seal the nozzles in the sealing space. In short, it is possible to adopt various configurations for the recording head, and if it is possible to seal the nozzles in the sealing space of the cap, the cap may be in close contact with any portion of the recording head.

In addition, in the above descriptions, a so-called bending vibration-type piezoelectric element 31 has been exemplified as the pressure generation unit, however, it is not limited to this. For example, it is also possible to adopt a so-called vertical vibration-type piezoelectric element. In this case, relating to the micro vibration pulse which is exemplified in the embodiment, a waveform in which a direction of change of a potential is reversed, that is, a waveform in which top and bottom are reversed is generated. In addition to this, it is also possible to apply the invention to a configuration in which a pressure generation unit such as a heat generation element which causes a pressure change by generating bubbles in ink using heat generation, and an electrostatic actuator which causes a pressure change by displacing a partitioning wall of the pressure chamber using an electrostatic force is adopted as the pressure generation unit.

What is claimed is:

1. A liquid ejecting apparatus comprising:

a liquid ejecting head which causes a pressure change in a pressure chamber by driving a pressure generation unit, and causes liquid containing a resin to be ejected from a nozzle;

a driving signal generator which generates a micro vibration pulse which causes a pressure change in liquid in the pressure chamber to an extent in which the liquid is not ejected from the nozzle by applying the micro vibration pulse to the pressure generation unit;

a controller which controls applying of the micro vibration pulse to the pressure generation unit;

a cap which includes a sealing space not including an absorber inside, and seals a nozzle in the sealing space by being in close contact with the liquid ejecting head; and a suction unit which sucks liquid from a nozzle by reducing a pressure in the sealed sealing space, wherein, at a time of a non-recording operation, micro vibration driving which causes liquid in the pressure chamber corresponding to a nozzle to be subjected to a micro vibration by applying at least one or more micro vibration pulses to the pressure generation unit corresponding to the nozzle in which a cleaning operation including a suction operation using the suction unit is performed is intermittently performed.

2. A control method of a liquid ejecting apparatus which includes a liquid ejecting head which causes a pressure change in a pressure chamber by driving a pressure generation unit, and causes liquid containing a resin to be ejected from a nozzle;

a driving signal generator which generates a micro vibration pulse which causes a pressure change in liquid in the pressure chamber to an extent in which the liquid is not ejected from the nozzle by applying the micro vibration pulse to the pressure generation unit;

a controller which controls applying of the micro vibration pulse to the pressure generation unit;

a cap which includes a sealing space not including an absorber inside, and seals the nozzle in the sealing space by being in close contact with the liquid ejecting head; and a suction unit which sucks liquid from the nozzle by reducing a pressure in the sealed sealing space, the method comprising:

intermittently performing micro vibration driving which causes liquid in the pressure chamber corresponding to the nozzle to be subjected to a micro vibration by applying at least one or more micro vibration pulses to the pressure generation unit corresponding to the nozzle in which a cleaning operation including a suction operation using the suction unit is performed, at a time of a non-recording operation.

* * * * *